US010472924B2

(12) United States Patent
Nicholson

(10) Patent No.: US 10,472,924 B2
(45) Date of Patent: Nov. 12, 2019

(54) APPARATUS AND METHODS FOR MANUAL OVERRIDE OF HYDRAULIC CHOKE OR VALVE ACTUATORS

(71) Applicant: Schlumberger Technology Corporation, Sugar Land, TX (US)

(72) Inventor: Christopher D. Nicholson, Cincinnati, OH (US)

(73) Assignee: Schlumberger Technology Corporation, Houston, TX (US)

( * ) Notice: Subject to any disclaimer, the term of this patent is extended or adjusted under 35 U.S.C. 154(b) by 371 days.

(21) Appl. No.: 15/129,058

(22) PCT Filed: Mar. 25, 2015

(86) PCT No.: PCT/US2015/022566
§ 371 (c)(1),
(2) Date: Sep. 26, 2016

(87) PCT Pub. No.: WO2015/148722
PCT Pub. Date: Oct. 1, 2015

(65) Prior Publication Data
US 2017/0191346 A1 Jul. 6, 2017

Related U.S. Application Data

(60) Provisional application No. 61/970,186, filed on Mar. 25, 2014.

(51) Int. Cl.
*F15B 13/10* (2006.01)
*E21B 34/02* (2006.01)
(Continued)

(52) U.S. Cl.
CPC ..... *E21B 34/02* (2013.01); *E21B 21/08* (2013.01); *E21B 21/106* (2013.01); *F15B 13/10* (2013.01);
(Continued)

(58) Field of Classification Search
CPC ..... F15B 13/10; F15B 2211/785; F15B 2211/8752
See application file for complete search history.

(56) References Cited

U.S. PATENT DOCUMENTS 4,213,480 A 7/1980 Orum et al.
4,295,390 A 10/1981 Buchta
(Continued)

FOREIGN PATENT DOCUMENTS

WO 2003093118 11/2003

OTHER PUBLICATIONS

International Search Report and Written Opinion regarding corresponding application No. PCT/US2015/022566; 12 pages; Jul. 6, 2015.

*Primary Examiner* — F Daniel Lopez
(74) *Attorney, Agent, or Firm* — Jeffrey D. Frantz

(57) ABSTRACT

A hydraulic actuator comprises a chamber, a first line, a second line, and an auxiliary line. The chamber allows fluid to move therethrough and comprises a movable element therein. The first line is in fluid communication with the chamber. The second line is in fluid communication with the chamber. The auxiliary line connects the first line and the second line and comprises a valve to selectively allow fluid communication between the first line and the second line as the movable element is moved in the chamber.

12 Claims, 7 Drawing Sheets

(51) Int. Cl.
*E21B 21/10* (2006.01)
*F15B 15/20* (2006.01)
*E21B 21/08* (2006.01)

(52) U.S. Cl.
CPC ..... *F15B 15/202* (2013.01); *F15B 2211/3058* (2013.01); *F15B 2211/324* (2013.01); *F15B 2211/785* (2013.01); *F15B 2211/8633* (2013.01); *F15B 2211/8752* (2013.01)

(56) References Cited

U.S. PATENT DOCUMENTS

| | | | | |
|---|---|---|---|---|
| 4,320,691 | A * | 3/1982 | McWilliams | F15B 13/042 137/596.15 |
| 4,650,151 | A | 3/1987 | McIntyre | |
| 5,122,344 | A | 6/1992 | Schmoegner | |
| 6,418,715 | B1 * | 7/2002 | Huber | B60J 7/1273 60/476 |
| 6,487,960 | B1 | 12/2002 | Chatufale | |
| 6,575,426 | B2 | 6/2003 | Sundararajan | |
| 6,609,533 | B2 | 8/2003 | Sundararajan | |
| 6,684,897 | B2 | 2/2004 | Sundararajan | |
| 7,434,395 | B2 | 10/2008 | He | |
| 2002/0050354 | A1 | 5/2002 | Schultz et al. | |
| 2005/0178560 | A1 | 8/2005 | Johansen et al. | |
| 2006/0192160 | A1 | 8/2006 | Cove | |
| 2008/0022672 | A1 | 1/2008 | He | |
| 2011/0011257 | A1 * | 1/2011 | Casassa | F15B 15/18 92/165 R |
| 2011/0248196 | A1 | 10/2011 | Anderson | |
| 2013/0068885 | A1 * | 3/2013 | Onomichi | B64C 25/22 244/102 R |

* cited by examiner

APPARATUS AND METHODS FOR MANUAL OVERRIDE OF HYDRAULIC CHOKE OR VALVE ACTUATORS

RELATED APPLICATION

This application is a national stage application of International Application No. PCT/US2015/022566 filed Mar. 25, 2015 that claims priority to and the benefit of a U.S. Provisional Patent Application having Ser. No. 61/970,186, filed 25 Mar. 2014, which is incorporated by reference in its entirety.

BACKGROUND

Controlling fluid pressure is needed and advantageous in many industries and environments. One such environment relates to controlling pressure in a wellbore during a drilling or another oilfield process.

Wells are drilled on land and in marine environments for a variety of exploratory and extractive purposes. Due to the variety of purposes, the conditions experienced while producing the wells also vary greatly. The particular conditions include changes in temperature, pressure, subterranean fluids, and formations, among other variables. Managed Pressure Drilling ("MPD") is used to ensure the pressure within the wellbore is maintained within predetermined limits relative to the surrounding formation pressure. The formation pressure may change during drilling of the wellbore. The applied fluid pressure by the drilling system is increased or decreased as necessary to keep the wellbore pressure within the desired limits. Chokes, for example, may be used to maintain the wellbore pressure within the predetermined limits.

BRIEF DESCRIPTION OF THE DRAWINGS

In order to describe the manner in which embodiments of the present disclosure may be used, a more particular description will be rendered by reference to specific embodiments as illustrated in the appended drawings. While some of the drawings are schematic representations of systems, assemblies, features, methods, or the like, at least some of the drawings may be drawn to scale. Understanding that these drawings depict example embodiments of the disclosure and are not therefore to be considered to be limiting of the scope of the present disclosure or to scale for each embodiment contemplated herein, the embodiments will be described and explained with additional specificity and detail through the use of the accompanying drawings in which.

DETAILED DESCRIPTION

Figure 1:
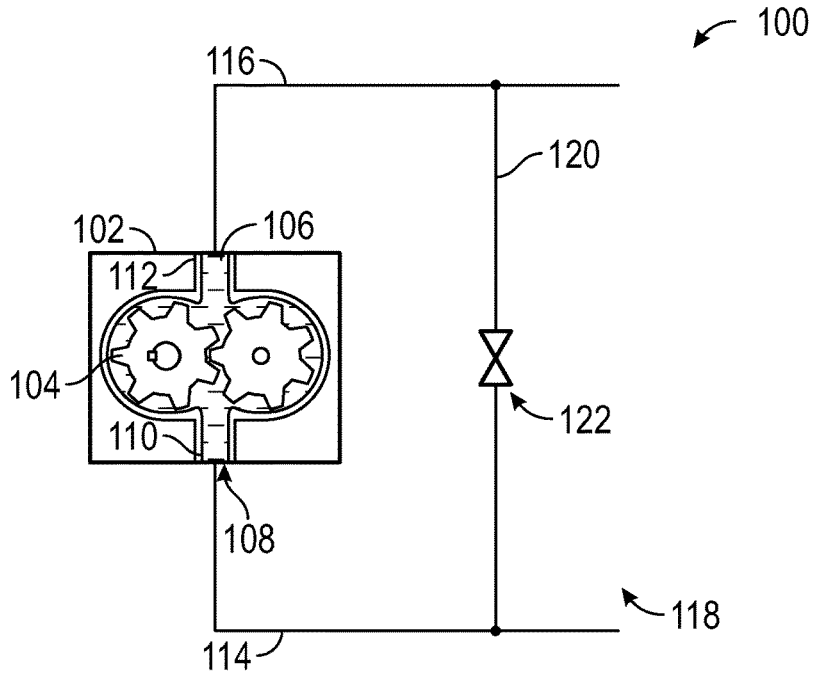
FIG. 1 is a first example embodiment of a hydraulic actuator configured as a hydraulic motor.

One or more specific embodiments of the present disclosure will be described below. These described embodiments are examples of the presently disclosed techniques. Additionally, in an effort to provide a concise description of these embodiments, not all features of an actual embodiment may be described in the specification. It should be appreciated that in the development of any such actual embodiment, as in any engineering or design project, numerous embodiment-specific decisions will be made to achieve the developers' specific goals, such as compliance with system-related and business-related constraints, which may vary from one embodiment to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features.

Examples will now be described more fully hereinafter with reference to the accompanying drawings in which example embodiments are shown. Whenever possible, the same reference numerals are used throughout the drawings to refer to the same or like parts. However, aspects may be embodied in many different forms and should not be construed as limited to the embodiments set forth herein. Any element described in relation to any embodiment may be freely combinable with any element described in relation to any other embodiment. Combinations of elements described in relation to different embodiments should be understood to be within the scope of the present disclosure.

The present disclosure relates generally to the movement of fluid. More particularly, the present disclosure related to movement of a hydraulic fluid within or in relation to a hydraulic actuator. A hydraulic actuator may convert fluid movement to a mechanical force or torque to do work on a system. For example, fluid movement may be used to move one or more movable elements in the hydraulic actuator, and the one or more movable elements may, in turn, move a gate to control fluid flow through a fluid choke. In some instances, an operator may desire to manually adjust the hydraulic actuator. The manual adjustment of the hydraulic actuator may be limited or substantially prevented by the presence of the hydraulic fluid within the hydraulic actuator. A hydraulic bypass or reservoir in communication with an inlet and an outlet of the hydraulic actuator may lessen or substantially remove the fluid pressure on the hydraulic actuator, thereby allowing the manual adjustment of the hydraulic actuator.

A hydraulically powered actuator can be used to operate a valve of a drilling choke. The actuator can be of various types—a single-acting cylinder, a double-acting cylinder, a hydraulic motor, or the like. In situations where automated control of the hydraulic actuator encounters a problem, it may be useful to have a hydraulic actuator that includes a manual override feature that disables the automatic control and allows for manual control of the actuator.

Providing a manual override feature in a hydraulic actuator can be complicated because the fluid left in the cylinder or motor can hydraulically lock the mechanism if there is no means for the fluid to flow out of the actuator during manual override operation. Generally, the hydraulic lines of the hydraulic actuator use quick-disconnect fittings that include check valves preventing the lines from leaking fluid when the quick-disconnect fittings are disconnected. Manual override is not possible with the quick-disconnect fittings because the fluid is left in the hydraulic lines and resists the manual override operation. The fittings have to either be disassembled or the lines have to be cut to allow the fluid to move and neither of these options is easy. Typically, the fittings are hard to disassemble and the hydraulic lines are high-pressure armored lines that are designed to be cut resistant. Moreover, suddenly releasing the pressure stored in the hydraulic lines through disassembly or cutting can be dangerous.

Thus, the presence of the fluid in the hydraulic lines of the hydraulic actuator and the difficulty of removing the fluid may present an obstacle to an operator responding to an emergency condition through manual override. Moreover, once the manual override operation is completed, the hydraulic actuator needs to be repaired or reassembled before normal operations can resume such that the downtime of the system can be reduced.

FIG. 1 shows a schematic representation of an embodiment of a hydraulic actuator 100 which is embodied as a hydraulic motor 102. The hydraulic motor 102 may include a set of gears 104 that are rotated through movement of a fluid 106 through a chamber 108 of the hydraulic motor 102. The chamber 108 may have a first port 110 and a second port 112 in fluid communication with the chamber 108. The fluid 106 may be directed through the hydraulic motor 102 from an inlet line 114 coupled to the first port 110 through to an outlet line 116 coupled to the second port 112. The inlet line 114 and the outlet line 116 may be in operative communication with one or more flow control devices that control the flow of the fluid 106 through the lines 114, 116 when the hydraulic actuator 100 is operating in an automatic mode. For example, an electric pump, manual pump, or pump driven by an internal combustion engine may apply a pressure to the inlet line 114 to move the fluid 106 through the hydraulic motor 102 and turn the gears 104. In another example, the pressure applied to the inlet line 114 may be at least partially a static pressure and/or columnar pressure of a fluid body in fluid communication with the inlet line. The gears 104 may be operatively connected to a fluid choke and configured to move a gate of the fluid choke relative to a seat of the fluid choke.

When the hydraulic actuator 100 is operated in a manual mode, a manual override system 118 may allow for an operator to move the fluid 106 through the hydraulic motor 102. The manual override system 118 may allow fluid 106 to move through the hydraulic motor 102 irrespective of the state of the devices that control the flow of the fluid 106 through the lines 114, 116 when the hydraulic actuator 100 is operating in an automatic mode. For example, if the aforementioned electric pump in communication with the inlet line 114 malfunctions, the fluid 106 in the inlet line 114 may become static and resist or prevent the movement of the hydraulic motor 102. The manual override system 118 may decouple the fluid 106 in the hydraulic motor 102 from the exclusive influence of the electric pump or other source of fluid pressure on the inlet line 114 and to provide a fluid bypass between the inlet line 114 and the outlet line 116, allowing manual operation of the gears 104.

The manual override system 118 may include an auxiliary line 120 connecting the inlet line 114 and the outlet line 116. The auxiliary line 120 may further include a valve 122 located on the auxiliary line 120. In some embodiments, the valve 122 may be a check valve, for example. The valve 122 may have an open position and a closed position. During automatic operation of the hydraulic actuator 100, the valve 122 may remain in the closed position limiting or preventing fluid communication between the inlet line 114 and the outlet line 116. When the hydraulic actuator 100 is operated in the manual mode, the valve 122 may be in the open position allowing fluid 106 trapped in the hydraulic motor 102 to flow out of the hydraulic motor 102 to the outlet line 116, into the auxiliary line 120, and back into the inlet line 114 of the hydraulic actuator 100. This movement allows the hydraulic motor 102 to spin during the manual mode operation. The electric pump or other source of fluid pressure on the inlet line 114 may continue to apply a fluid pressure to the fluid 106 within the hydraulic actuator 100 during manual mode operation. The fluid 106 may flow through the auxiliary line 120 between the inlet line 114 and outlet line 116 irrespective of the fluid pressure applied by the electric pump or other source of fluid pressure on the inlet line 114. The inlet line 114 and outlet line 116 may include additional features or valves to channel fluid partly or entirely into the auxiliary line 118. As soon as the manual mode operation is completed, the valve 122 may be moved to the closed position to resume automatic mode operations.

Figure 2:
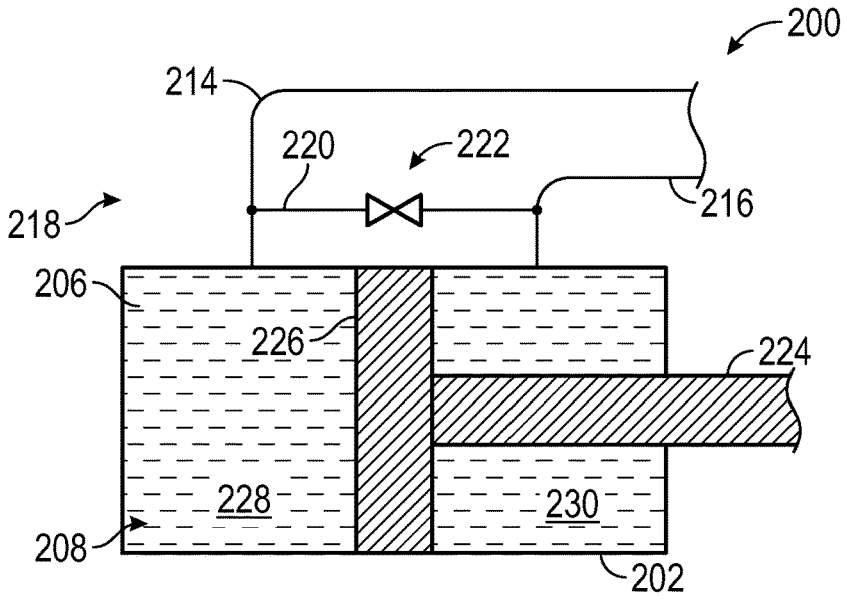
FIG. 2 is a second example embodiment of the hydraulic actuator configured as a hydraulic cylinder.

FIG. 2 shows a second schematic embodiment of the hydraulic actuator 200.

The hydraulic actuator 200 includes a hydraulic cylinder 202 which includes a stem or shaft 224 leading to a piston 226. The piston 226 may divide a chamber 208 of the cylinder 202 into a first chamber portion 228 and a second chamber portion 230. The hydraulic actuator 200 may further include a first line 214 that is in fluid communication with the first chamber portion 228 and a second line 216 that is in fluid communication with the second chamber portion 230. The first line 214 and the second line 216 may be in operative communication with flow control devices, e.g., pumps, which control the flow of fluid through the lines 214, 216 and, therefore, movement of the movable element, e.g., the piston 226, during automatic operation.

During automatic operation, a fluid 206 can be supplied through the first line 214 into the first chamber portion 228 in order to move the piston 226 in a first direction within the chamber 208 while the fluid 206 can also be supplied to the second line 216 into the second chamber portion 230 in order to move the piston 226 in a second, opposite direction within the chamber 208. The manual override system 218 may include an auxiliary line 220 connecting the first line 214 and the second line 216 and may further include a valve 222 on the auxiliary line 220. The inlet and outlet lines 214, 216 may include additional features or valves to channel the fluid 206 partly or entirely into the auxiliary line 220. In some embodiments, the valve 222 may be a two-way valve.

During manual mode operation, the valve 222 may be moved to an open position to allow fluid communication between the first line 214 and the second line 216. The presence of the stem 224 creates a varying rate of change in the volume of the second chamber portion 230 during movement of the stem 224 and piston 226. For example, for a given displacement of the stem 224 and piston 226, the change in volume of the first chamber portion 228 may be greater than the change in volume in the second chamber portion 230. Therefore, the volume of the fluid 206 moving into and/or out of the first chamber portion 228 may be greater than the volume of the fluid 206 moving into and/or out of the second chamber portion 230. If the manual override system 218 does balance this volumetric difference, a pressure difference between the first chamber portion 228 and the second chamber portion 230 may bias the piston 226 in one direction. If the fluid 206 is environmentally benign, the extra volume may simply be vented to the atmosphere.

In some embodiments, a stem or shaft of a manual crank may open/expose additional volume in the second chamber portion 230, such as by including apertures, recesses, or pockets within a stem or shaft of the manual crank in communication with the second chamber portion 230 to manually adjust the volume of the second chamber portion 230. Adjustment of the volume of the second chamber portion 230 may allow hydraulic pressure to release flow from one side of the actuator to the other as the manual crank is cranked or turned.

Figure 3:
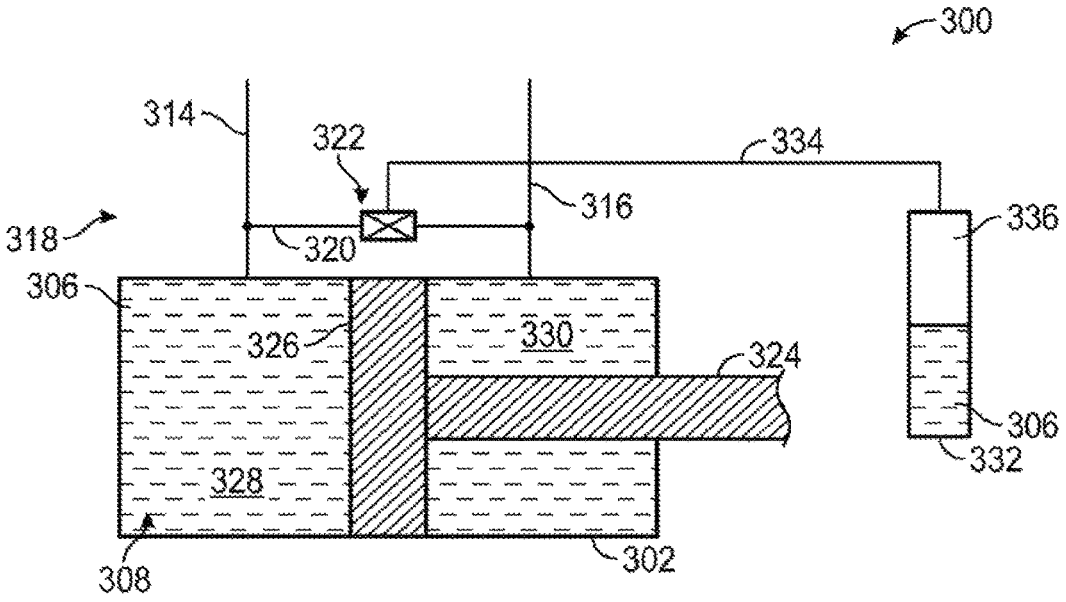
FIG. 3 is a third example embodiment of the hydraulic actuator configured as a hydraulic cylinder where the hydraulic actuator includes a reservoir.

FIG. 3 shows a schematic representation of an embodiment of a hydraulic actuator 300 including a reservoir in fluid communication with an auxiliary line to compensate for and/or balance a volume change of a hydraulic cylinder during manual mode operation of the hydraulic actuator 300. The hydraulic actuator 300 may be similar to the hydraulic actuator 200 described in relation to FIG. 2. For example, the hydraulic actuator 300 may include a manual override system 318, a hydraulic cylinder 302, a first line 314, a second line 316, a stem 324, a piston 326, a first chamber portion 328, and a second chamber portion 330.

The manual override system 318 may include an auxiliary line 320 and a valve 322. The valve 322 may be a three-way valve 322 that may provide fluid communication with a reservoir 332 via a reservoir line 334 coupled to the valve 322. The valve 322 may, thereby, provide fluid communication between the auxiliary line 320 and the reservoir line 334. The reservoir 332 may allow the extra volume of fluid 306 to move out of the chamber 308 of the hydraulic cylinder 302 and still be contained within the entire hydraulic actuator 300. In some embodiments, the reservoir 332 may have a volume greater than the anticipated volume of fluid 306 displaced during manual mode operation of the hydraulic actuator 300. In other embodiments, the reservoir 332 may initially contain fluid 306 to accommodate displacement of the stem 324 and piston 326 toward (i.e., a reduction of volume of) the second chamber portion 330 and away from (i.e., an increase of volume of) the first chamber portion 328. For example, the reservoir 332 may initially include a volume of fluid 306 greater than the anticipated volume of fluid 306 displaced during manual mode operation of the hydraulic actuator 300. The reservoir 332 may initially include a volume of vacuum or compressible gas 336 greater than the anticipated volume of fluid 306 displaced during manual mode operation of the hydraulic actuator 300. The reservoir 332 may be twice the volume of the stem 324 and may be partially full to either absorb or provide the fluid 306 displaced during manual mode operation of the hydraulic actuator 300. In other embodiments, the reservoir 332 may be at least partially expandable, collapsible, or otherwise configured to adjust volume to accommodate the displacement of fluid 306 from the hydraulic chamber 302.

Figure 4:
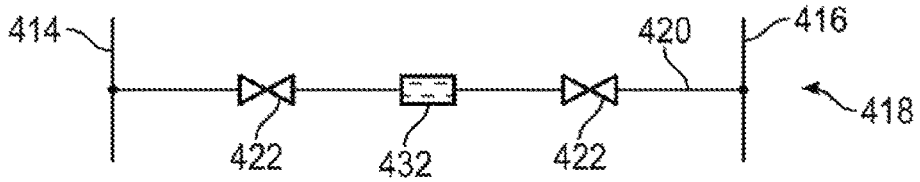
FIG. 4 is a first example embodiment of a manual override system for a hydraulic cylinder where the manual override system includes a reservoir in series.
Figure 5:
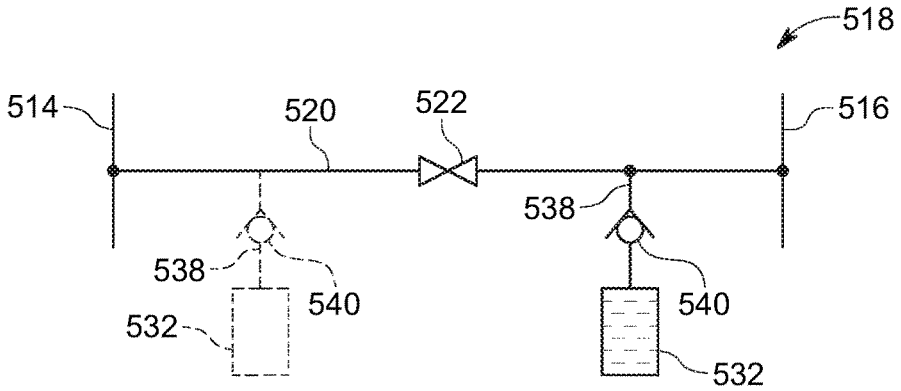
FIG. 5 is a second example embodiment of a manual override system for a hydraulic cylinder where the manual override system includes at least one reservoir branching from the auxiliary line.
Figure 6:
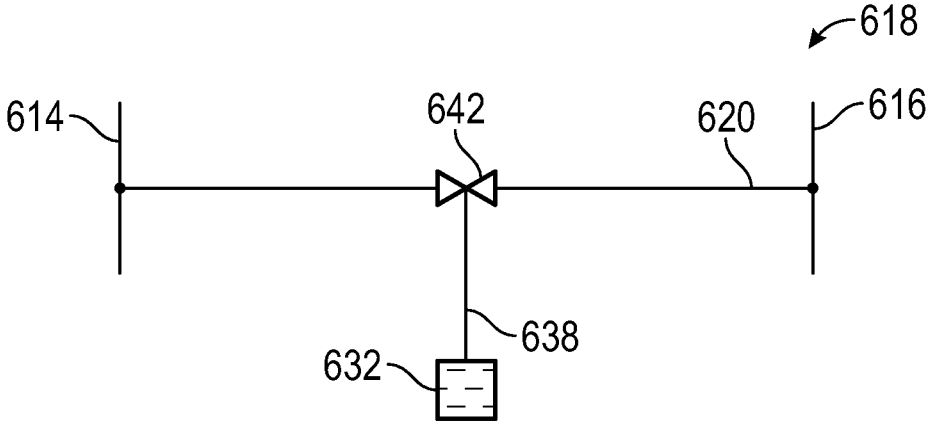
FIG. 6 is a third example embodiment of a manual override system for a hydraulic cylinder where the manual override system includes a three-way valve.

In other embodiments, an inlet line, an outlet line and a reservoir may be connected by two two-way valves, as shown in FIG. 4 and FIG. 5, or one three-way valve, as shown in FIG. 6. A manual override system 418 including two two-way valves is shown in FIG. 4. The manual override system 418 may be connected to a first line 414 and a second line 416 of a hydraulic motor or cylinder and may include an auxiliary line 420, two-way valves 422, and a reservoir 432. The first line 414 and the second line 416 may be in fluid communication with a chamber of the hydraulic motor or cylinder similar to those described in relation any of FIG. 1 through FIG. 3. The reservoir 432 may be located serially along the auxiliary line 420 between the two two-way valves 422. During automatic operation, the two-way valves 422 may remain in a closed position such that the reservoir 432 is not in fluid communication with the first line 414 and the second line 416. During manual mode operation, the two-way valves 422 may be moved to an open position to allow fluid to be directed to the reservoir 432. The reservoir 432 may include sufficient volume within the reservoir or an adjustable volume of the reservoir 432 to allow fluid to remain in the reservoir 432 and allow for the varying rate of volume change between the portions of the chamber that is separated by a stem and piston such as that described in relation to FIG. 2. As discussed above, the inlet and outlet lines 414, 416 may include additional features or valves to channel fluid partly or entirely into the auxiliary line 420. One embodiment of the two-way valve 422 may be a ball or plug valve or a "quarter turn" valve that can be changed from the closed position to the open position quickly.

FIG. 5 shows a different embodiment of the manual override system 518 in which a two-way valve 522 is used. The manual override system 518 includes a reservoir line 538. The reservoir line 538 may provide fluid communication with the reservoir 532 and the auxiliary line 520 between the two-way valve 522 and the second line 516. The reservoir line 538 may include a one-way valve 540 that allows entry into the reservoir 532 but prevents exit therefrom. The one-way valve 540 may be a check valve, for example. As shown in FIG. 5, in other embodiments, the auxiliary line 540 between the two-way valve 522 and the first line 514 may include a reservoir line 538 providing fluid communication with the reservoir 532 and the auxiliary line 520. In yet other embodiments, the manual override system 518 may include a first reservoir in fluid communication with the auxiliary line 520 on a first side of the two-way valve 522 and a second reservoir in fluid communication with the auxiliary line 520 on a second side of the two-way valve 522.

Figure 7:
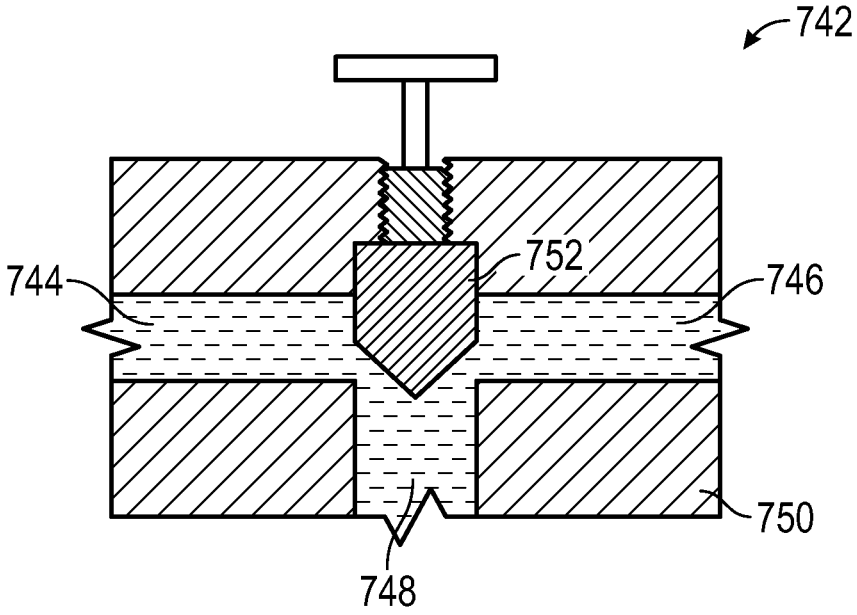
FIG. 7 is an example embodiment of a three-way valve provided in a manual override system.

FIG. 6 depicts a schematic representation of a manual override system 618. The manual override system 618 may be connected to a first line 614 and a second line 616 of a hydraulic motor or cylinder and may include an auxiliary line 620, a three-way valve 642, and a reservoir 632 connected to the three-way valve 642 by a reservoir line 638. The first line 614, the second line 616, and the reservoir 632 may be fluid communication with each other when the three-way valve 642 is in an open position. The first line 614, the second line 616, and the reservoir 632 may not be in fluid communication with each other when the three-way valve 642 is in a closed position. In some embodiments, the seat of the three-way valve 642 may include three passages in a "T' orientation. For example, the three-way valve 642 is configured such that fluid communication between the first line 614 and the second line 616 is prevented and such that fluid communication from either the first line 614 or the second line 616 to the reservoir 632 is prevented when the valve 20*a* is closed. The schematic representation of a three-way valve 742 in FIG. 7 includes a threaded configuration so that it can be rotatably opened or closed. When the three-way valve 742 is in an open position as shown in FIG. 7, fluid communication between a first port 744 and a second port 746 and fluid communication from either of the first port 744 or the second port 746 to a third port 748 may be established. In other words, the three-way valve 742 seals all three ports (i.e., the first port 744, the second port 746, and the third port 748) from each other when the valve is in a closed position and the seat 750 is in contact with the gate 752. In some embodiments, the seat 750 may have a geometry that corresponds to the geometry of the gate 752. When the three-way valve 742 is in an open position and the gate 752 is not in contact with the seat 750 of the three-way valve 742, the three ports 744, 746, 748 may be connected for fluid communication.

Figure 8:
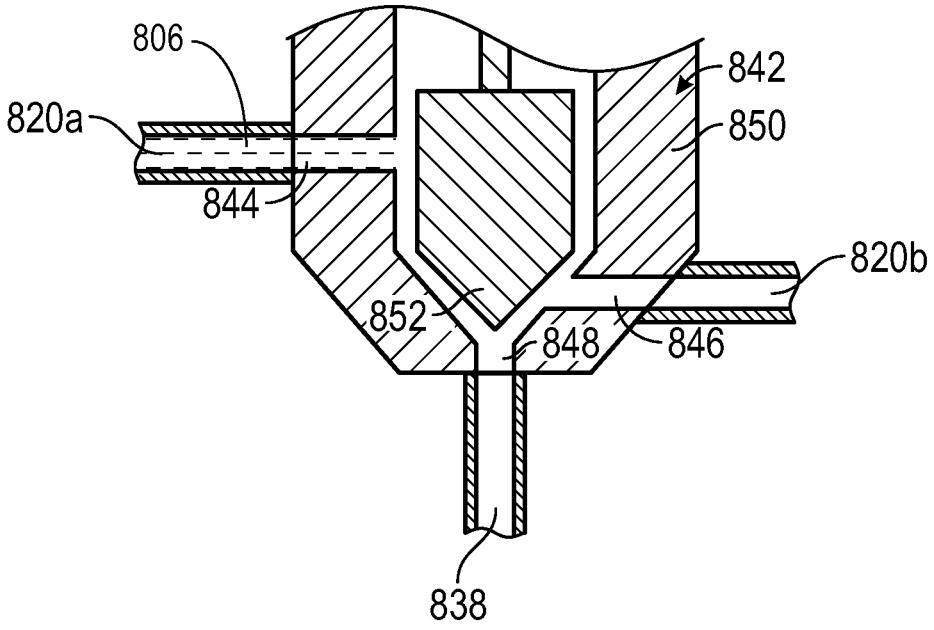
FIG. 8 is an example embodiment of a three-way needle valve provided in a manual override system.
Figure 9:
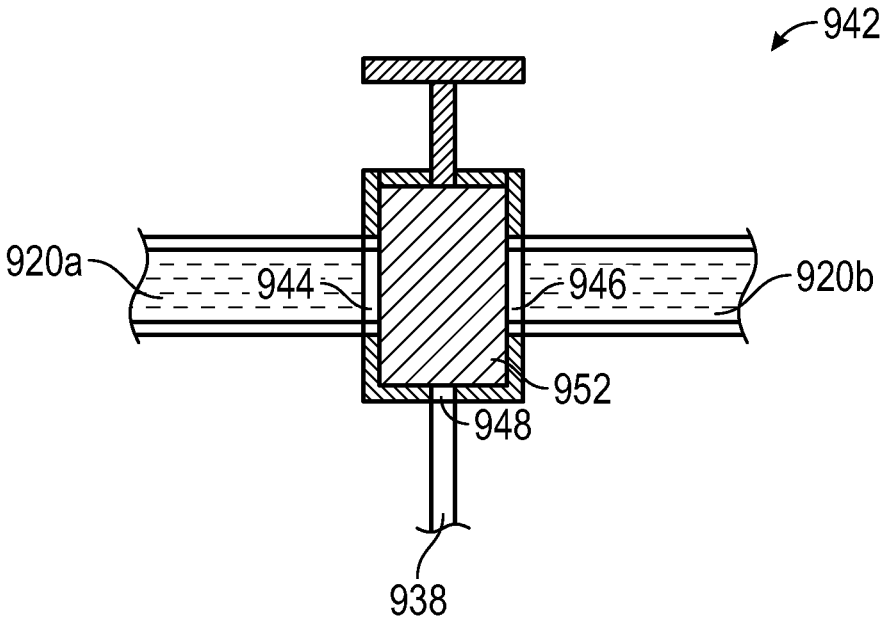
FIG. 9 is an example embodiment of a three-way gate provided in a manual override system.
Figure 10:
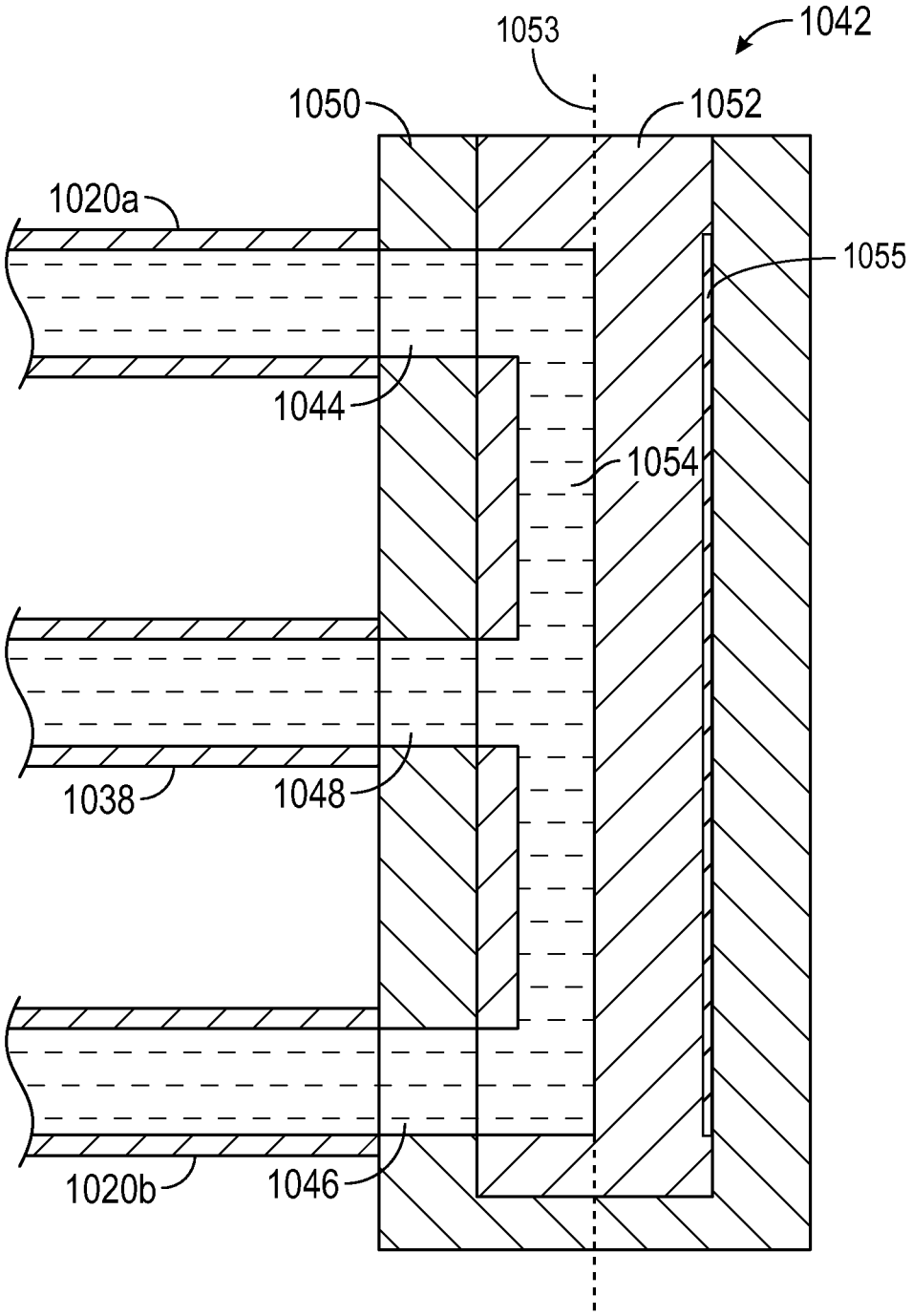
FIG. 10 is an example embodiment of a three-way valve having a rotatable gate provided in a manual override system.

Other embodiments of a three-way valve 842, 942, 1042 are shown in FIGS. 8 through 10. The three-way valve 842, shown in FIG. 8, may be a needle valve. The three-way valve 842 may include a first port 844, a second port 846, and a third port 848 that each provide fluid communication with an interior volume of the three-way valve 842. The first port 844, second port 846, and third port 848 may be connectable to fluid conduits to provide selective fluid communication therebetween. For example, the first port 844 may be connected to a first auxiliary line 820*a*, the second port 846 may be connected to a second auxiliary line 820*b*, and the third port 848 may be connected to a reservoir line 838. In other examples, the first port 844, second port 846, and third port 848 may be connected to the first auxiliary line 820*a*, second auxiliary line 820*b*, and reservoir line 838 in other configurations. In yet other examples, the first port 844, second port 846, and third port 848 may be connected to other fluid conduits, such as additional reservoir lines to provide fluid communication to additional reservoirs of fluid. In yet another example, at least one of the first port 844, second port 846, and third port 848 may be sealed to allow the three-way valve 842 to operate as a two-way valve.

In some embodiments, the first port 844 and second port 846 of the three-way valve 842 may be positioned in the body or seat 850 of the three-way valve 842 longitudinally offset from one another. For example, the first port 844 and second port 846 may be covered or partially covered by a gate 852 of the three-way valve 842 at different positions within the range of motion of the gate 852. The three-way valve 842 may, therefore, have an open position in which the first port 844, second port 846, and third port 848 may be in fluid communication with one another; a closed position in which the first port 844, second port 846, and third port 848 may not be in fluid communication with one another; and an intermediate position in which two of the three ports are in fluid communication with one another. For example, the three-way valve 842 may have an intermediate position in which the second port 846 and the third port 848 are in fluid communication with one another while the first port 844 may remain sealed relative to the other ports. In some embodiments, an intermediate position may allow bleeding of one of the hydraulic lines while not allowing for a hydraulic bypass of the hydraulic actuator or may allow for a direct bypass of a first line and a second line in a hydraulic actuator while selectively allowing the use of a reservoir also connected to the three-way valve 842.

FIG. 8 shows a fluid 806 entering the three-way valve 842 through the first auxiliary line 820*a* connected to the first port 844. In some embodiments, the needle valve gate 852 may be positioned to substantially prevent flow through the three-way valve 842. In other embodiments, such as that depicted in FIG. 8, the relative position and/or size of the gate 852 and the seat 850 may allow some flow around or past the gate 852, while the relative position and/or size affects the flow rate of the fluid 806 through the three-way valve 842 to one or more of the ports therein.

Referring now to FIG. 9, a three-way valve 942 may have a square or knife gate 952. The square or knife gate 952 may seal against the seat to provide a stronger valve than a needle valve such as three-way valve 942. For example, the material of the seat 0 and/or gate 952 may wear over time with use of the system. As the sealing and/or unsealing of the three-way 942 may allow the automatic and/or manual modes of a hydraulic actuator, it may be desirable to mitigate or prevent operational wear of the three-way valve 942. For embodiments in which mitigation or prevention of operational wear may not be possible, mitigation or prevention of the impact of the operation wear on the performance of the three-way valve 942 may be desirable.

As shown in FIG. 10, another embodiment of a three-way valve 1042 may be a spool-valve where a first auxiliary line 1020*a*, a second auxiliary line 1020*b*, and a reservoir line 1038 fluid passages enter parallel to each other and perpendicular to the chamber of the valve through a first port 1044, a second port 1046, and a third port 1048, respectively. A cylindrical seat 1050 may include a rotatable gate 1052 that is rotated axially about a longitudinal axis 1053 of the rotatable gate 1052 within the cylindrical seat 1050 and may have one or more seals 1055 that separate the first port 1044, second port 1046, and third port 1048 from each other when the rotatable gate 1052 is in a closed position. When the rotatable gate 1052 is rotated axially to an open position shown in FIG. 10, the passages may be uncovered and fluid would be allowed to flow between the first port 1044, second port 1046, and third port 1048 through a channel 1054 in the cylindrical gate 1052. The cylindrical gate 1052 may, in other embodiments, include additional channels 1054 that may provide fluid communication between different combinations of the first port 1044, second port 1046, and third port 1048 to provide selective fluid communication therebetween. In yet other embodiments, the three-way valve 1042 may include outlet ports allowing the connection of the three-way valve 1042 directly to the first line and second line of a hydraulic actuator. In a first position, fluid from the first line and second line may each flow through the three-way valve 1042 without interference to allow automatic mode operation of the hydraulic actuator. In a second position, the rotatable gate 1052 may be rotated to redirect fluid flow from the first line directly to the second line to provide fluid communication therebetween, scaling the first line and second line external to the hydraulic actuator and allowing manual mode operation of the hydraulic actuator.

Figure 11:
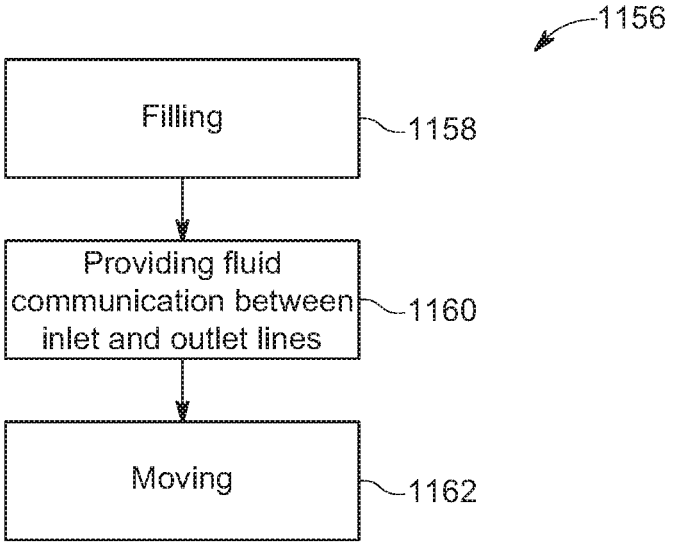
FIG. 11 is a flowchart depicting a method of manually overriding a hydraulic actuator.

FIG. 11 is a flowchart depicting a method 1156 of manually overriding a hydraulic choke or valve actuator. The method 1156 may include filling 1158 an interior space of a chamber or other housing with a fluid. The fluid may enter the chamber through an inlet line and exit the chamber through an outlet line. The chamber or other housing may contain a movable element, such as a gear or a piston, in contact with the fluid. In some embodiments, the method 1156 may include connecting the inlet line and the outlet line through an auxiliary line. In other embodiments, the auxiliary line may have a valve therein to selectively allow fluid flow through the auxiliary line.

The method 1156 may include providing 1160 fluid communication between the inlet line and the outlet line through the auxiliary line, for example, by moving the valve in the auxiliary line to an open position. The method 1156 may include moving 1162 the movable element contained in the chamber or housing to generate fluid flow though the auxiliary line.

In some embodiments, the method 1156 may include disabling fluid communication between the inlet line and the outlet line through the auxiliary line, and moving fluid through the interior space of a chamber thereby generating movement of the movable element. In other embodiments, the chamber may have a first chamber portion and a second chamber portion. The first chamber portion and second chamber portion may have a different rate of volumetric change upon moving the movable element. For example, the first chamber portion may change volume more or less than the second chamber portion in response to a given movement of the movable element. In yet other embodiments, connecting the inlet line and the outlet line may include connecting a reservoir in fluid communication with the auxiliary line. In still further embodiments, generating fluid flow through the auxiliary line may include allowing fluid to flow into or out of the reservoir.

Figure 12:
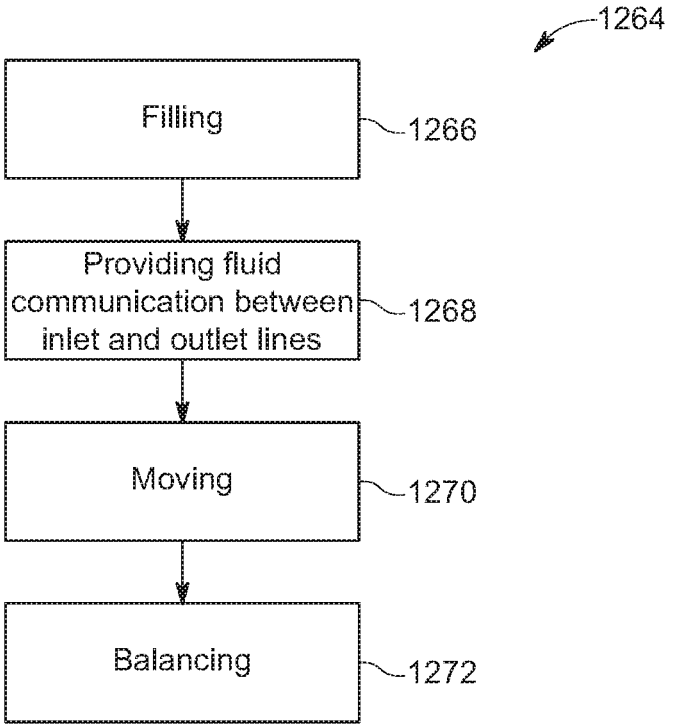
FIG. 12 is a flowchart depicting a method of manually overriding a hydraulic actuator using a reservoir.

FIG. 12 is a flowchart depicting another embodiment of a method 1264 of manually overriding a hydraulic actuator using a reservoir to balance volumetric changes in a chamber of the hydraulic actuator. Similar to the method 1156 described in relation to FIG. 11, the method 1264 may include filling 1266 an interior space of a chamber or other housing with a fluid. The fluid may enter the chamber through an inlet line and exit the chamber through an outlet line. The chamber or other housing may contain a movable element, such as a gear or a piston, in contact with the fluid.

In some embodiments, the method 1264 may include connecting the inlet line and the outlet line to one another and to a reservoir through an auxiliary line. In other embodiments, the reservoir may be at least partially full with fluid. In yet other embodiments, the reservoir may be empty. In yet further embodiments, the reservoir may be filled with fluid.

The method 1264 may include providing 1268 fluid communication between the inlet line, outlet line, and reservoir, for example, by moving a three-way valve in the auxiliary line to an open position. In some embodiments, providing 1268 fluid communication between the inlet line, outlet line, and reservoir may be simultaneous. In other embodiments, providing 1268 fluid communication between the inlet line, outlet line, and reservoir may be asynchronous. For example, providing 1268 fluid communication between the inlet line and outlet line may include opening a first valve in the auxiliary line at a first time and establishing fluid communication with the reservoir may include opening a second valve in a reservoir line at a second, different time.

The method 1264 may include moving 1270 the movable member to generate fluid flow though the auxiliary line. The method 1264 may include balancing 1272 a volumetric change in a first chamber portion relative to a second chamber portion. In some embodiments, the volumetric change may be balanced by allowing at least part of the fluid to flow into or out of the reservoir. For example, the movable element may have a greater volume (i.e., a stem of a piston) in the second chamber portion than the first chamber portion, thereby altering the volume of the second chamber portion at a different rate than the first chamber portion during movement of the movable element. Balancing 1272 the volumetric change in a first chamber portion relative to a second chamber portion may limit or prevent damage to the hydraulic actuator.

Other embodiments of the manual override system may be configured such that the valve and/or the reservoir are integrated directly into the body of the hydraulic motor or cylinder thereby making the overall apparatus more compact. The valve may be incorporated into the hydraulic power unit (i.e., the control console). However, the control console may potentially be located far away from the actuator thereby increasing the response time since the operator would need to move back and forth between the control console and the actuator. Thus, the valve may be integrated into both the console and the actuator so that it can be activated from either location. However, if valves are located at both locations, the potential exists for a valve at one location to be open unbeknownst to the operator thereby causing an erratic system response when normal operation is started. To prevent this, the operation of the valves may be linked together using a push/pull cable, an electric mechanism, a hydraulic mechanism or a mechanism similar to that described in U.S. patent application Ser. No. 13/942,420 which was filed on Jul. 15, 2013 and is hereby incorporated by reference in its entirety. In another embodiment, an indicator mechanism may be incorporated between the valves to allow the operator to see the valve configuration from either location. An indicator feature may be advantageous even when as single valve is used.

The manual override system may also be applied to pneumatic systems or other types of fluid power systems not mentioned herein or any other type of systems where relief of excess fluid or pressure for manual override operation may be helpful.

The term "substantially" as used herein represent an amount close to the stated amount that still performs a desired function or achieves a desired result. For example, the term "substantially" may refer to an amount that is within less than 10% of, within less than 5% of, within less than 1% of, within less than 0.1% of, and within less than 0.01% of a stated amount. Further, it should be understood that any directions or reference frames in the preceding description are merely relative directions or movements. For example, any references to "up" and "down" are merely descriptive of the relative position or movement of the related elements. Any specific values described herein should be understood to not be limited to that value, but rather to encompass that value and associated values within a range within less than 10% of, within less than 5% of, within less than 1% of, within less than 0.1% of, and within less than 0.01% of a stated amount.

It should also be understood that while several embodiments are described, any element described in relation to any embodiment may be combined with any element described in relation to any other embodiment, as appropriate. Although the preceding description has been described herein with reference to particular means, materials and embodiments, it is not intended to be limited to the particulars disclosed herein; rather it extends to all functionally equivalent structures, methods and uses, such as are within the scope of the appended claims.

What is claimed is:

1. A method comprising:

automatically filling an interior space of a chamber with a fluid using a flow control device in an automatic mode, wherein the fluid is configured to enter the chamber through an inlet line and to exit the chamber through an outlet line, the chamber contains a movable element in contact with the fluid, an auxiliary line extends from the inlet line to the outlet line such that the auxiliary line connects the inlet line to the outlet line, and a first reservoir or a first reservoir line of the first reservoir is connected to the auxiliary line between the inlet line and the outlet line;

providing fluid communication between the inlet line, the outlet line, and the first reservoir through the auxiliary line or the auxiliary line and the first reservoir line of the first reservoir;

generating fluid flow though the auxiliary line to balance a volumetric change in a first chamber portion of the chamber relative to a second chamber portion of the chamber by moving the movable element when the automatic mode malfunctions; and moving a first valve to an open position to provide fluid communication between the inlet line and the outlet line and moving a second valve to an open position to provide fluid communication between the auxiliary line and the first reservoir or the first reservoir line of the first reservoir.

2. The method of claim 1, wherein moving the moveable element is performed manually.

3. The method of claim 1, further comprising:

connecting the inlet line to a second reservoir through the auxiliary line, wherein fluid communication between the inlet line and the second reservoir is provided through the auxiliary line.

4. A hydraulic actuator comprising:

a chamber comprising an interior space in which fluid and a movable element are located, wherein movement of one of the movable element and the fluid generates movement of the other of the movable element and the fluid;

an inlet line in fluid communication with the interior space;

an outlet line in fluid communication with the interior space;

an auxiliary line extending from the inlet line to the outlet line such that the auxiliary line connects the inlet line to the outlet line;

an auxiliary valve on the auxiliary line between the inlet line and the outlet line;

a first reservoir or a first reservoir line of the first reservoir connected to the auxiliary line between the inlet line and the outlet line such that the inlet line, the outlet line and the first reservoir are in fluid communication through the auxiliary line and the auxiliary valve or the auxiliary line, the auxiliary valve and the first reservoir line; and a second reservoir connected to the auxiliary line by a second reservoir line, wherein the auxiliary valve is manually movable to an open position and the auxiliary valve, when located in the open position, provides fluid communication between at least the inlet line and the outlet line.

5. The hydraulic actuator of claim 4, wherein the auxiliary valve has a closed position that substantially prevents fluid communication between the inlet line and the outlet line.

6. The hydraulic actuator of claim 4, wherein the chamber further comprises a first chamber portion and a second chamber portion, the auxiliary line is in fluid communication with the first reservoir, and the first reservoir is configured to balance volumetric differences in the first chamber portion and the second chamber portion as the movable element moves relative to the chamber.

7. The hydraulic actuator of claim 6, wherein the volumetric differences are balanced by fluid moving through the auxiliary line toward either the first chamber portion or the second chamber portion.

8. The hydraulic actuator of claim 4, wherein the auxiliary valve is a three-way valve having an open position and a closed position, the open position is configured to provide fluid communication between the inlet line, outlet line, and the first reservoir, and the closed position is configured to prevent fluid communication between the inlet line, outlet line, and the first reservoir.

9. A method comprising:

automatically filling an interior space of a chamber with a fluid using a flow control device in an automatic mode, wherein the fluid is configured to enter the chamber through an inlet line and to exit the chamber through an outlet line, the chamber contains a movable element in contact with the fluid, an auxiliary line extends from the inlet line to the outlet line such that the auxiliary line connects the inlet line to the outlet line, and a first reservoir or a first reservoir line of the first reservoir is connected to the auxiliary line between the inlet line and the outlet line;

providing fluid communication between the inlet line, the outlet line, and the first reservoir through the auxiliary line or the auxiliary line and the first reservoir line of the first reservoir;

connecting the inlet line to a second reservoir through the auxiliary line, wherein fluid communication between the inlet line and the second reservoir is provided through the auxiliary line; and generating fluid flow though the auxiliary line to balance a volumetric change in a first chamber portion of the chamber relative to a second chamber portion of the chamber by moving the movable element when the automatic mode malfunctions.

10. The method of claim 9, further comprising:

disabling fluid communication between the inlet line and the outlet line through the auxiliary line; and moving fluid through the interior space of a chamber thereby generating movement of the movable element.

11. The method of claim 9, wherein the chamber has a first chamber portion and a second chamber portion and the first chamber portion and second chamber portion have a different rate of volumetric change upon moving the movable element.

12. The method of claim 9, wherein moving the movable element to generate fluid flow through the auxiliary line further comprises:

flowing fluid into or out of at least one of the first reservoir and the second reservoir.

* * * * *